US010392144B2

(12) United States Patent
Zhao et al.

(10) Patent No.: US 10,392,144 B2
(45) Date of Patent: Aug. 27, 2019

(54) HYDRAULIC STEEL STRAPPING MACHINE

(71) Applicant: MEISHAN CRRC FASTENING SYSTEM CO., LTD., Meishan (CN)

(72) Inventors: Xiangyun Zhao, Meishan (CN); Kai Fu, Meishan (CN); Yu Liu, Meishan (CN); Wei Li, Meishan (CN); Min Lei, Meishan (CN); Huan Li, Meishan (CN)

(73) Assignee: MEISHAN CRRC FASTENING SYSTEM CO., LTD., Meishan (CN)

( * ) Notice: Subject to any disclaimer, the term of this patent is extended or adjusted under 35 U.S.C. 154(b) by 366 days.

(21) Appl. No.: 15/361,463

(22) Filed: Nov. 27, 2016

(65) Prior Publication Data

US 2018/0118386 A1 May 3, 2018

(30) Foreign Application Priority Data

Nov. 2, 2016 (CN) ..... 2016 1 0944635

(51) Int. Cl.

| | |
|---|---|
| ***B65B 13/22*** | (2006.01) |
| ***B65B 13/02*** | (2006.01) |
| ***B65B 13/34*** | (2006.01) |
| *B65B 27/06* | (2006.01) |

(52) U.S. Cl.

CPC ..... *B65B 13/22* (2013.01); *B65B 13/025* (2013.01); *B65B 13/345* (2013.01); *B65B 27/06* (2013.01)

(58) Field of Classification Search

CPC ..... B65B 13/30; B65B 13/185; B65B 13/187; B65B 27/06

See application file for complete search history.

(56) References Cited

U.S. PATENT DOCUMENTS 3,198,218 A * 8/1965 Ericsson ..... B65B 13/34 140/151
3,396,760 A * 8/1968 Kirsinas ..... B65B 13/345 140/93.4
3,552,305 A * 1/1971 Dorney ..... B65B 13/22 100/32
3,794,086 A * 2/1974 Hall ..... B21F 9/02 140/93.2

* cited by examiner

*Primary Examiner* — Shelley M Self
*Assistant Examiner* — Jared O Brown
(74) *Attorney, Agent, or Firm* — Chieh-Mei Wang

(57) ABSTRACT

A hydraulic steel strapping machine for strapping a steel strip around a package, including a clamping and cutting section and a tensioning section. An objective of the present invention is to minimize the weight and the volume of the steel strapping machine. The clamping and cutting section comprises a clamping cylinder, disposed on a top position of a front end of the hydraulic steel strapping machine along a Z direction and supported by a support frame, for driving a linkage mechanism. A cylinder pin is disposed in the linkage mechanism along a X direction and is sleeved by a lifting lug fixed onto a bottom surface of a piston of the clamping cylinder. A pressing part is sleeved around the cylinder pin, a cutter, a return spring and a transverse cutter are disposed below the pressing part. The linkage mechanism comprises two groups of connecting rods.

4 Claims, 6 Drawing Sheets

HYDRAULIC STEEL STRAPPING MACHINE

FIELD OF THE INVENTION

The invention belongs to the class of general pressure machine, and specifically relates to a hydraulic steel strapping machine for strapping a steel strip around a package, including a clamping and cutting section and a tensioning section.

BACKGROUND OF THE INVENTION

The known steel strapping machines mainly utilize pneumatic cylinder to, tension, clamp and cut a steel strip. However, as compared with a hydraulic cylinder, a pneumatic cylinder produces smaller tension and clamp strength, and hence requires larger cylinder capacity, leading to weight disadvantage.

Since steel strapping machines are used at a wide variety of locations, they are often handled manually and moved, for example, to various usage sites. From such point of view, it is very important that the machine causes minimal physical loads for users.

BRIEF SUMMARY OF THE INVENTION

An objective of the present invention is therefore to minimize the weight and the volume of the steel strapping machine.

The present objective could be achieved according to the present invention by virtue of the fact that the clamping and cutting section and the tensioning section are both driven by the hydraulic cylinders.

The present invention is advantageous in that the driven power is provided by three hydraulic cylinders. Particularly, the clamping and cutting section has a clamping cylinder, while the other two parallel tensioning cylinders belong to the tensioning section. The hydraulic cylinders have a small volume and light weight, demonstrating their volume and weight benefits. Moreover, the output of hydraulic cylinders is much larger than that of pneumatic cylinders, applying a larger deforming force on a buckle and a steel strip. As a result, a thicker steel strip could be used to strap around a package.

In a preferred embodiment of the present invention, the clamping cylinder is disposed on the top portion of a support frame, driving a linkage mechanism along the Z direction. A cylinder pin of the clamping cylinder is disposed in the linkage mechanism along the X direction, and is sleeved by a lifting lug fixed on the bottom surface of the piston of the clamping cylinder. A pressing part is sleeved around the cylinder pin. A cutter, a return spring and a transverse cutter are placed below the pressing part.

As mentioned above, the linkage mechanism includes one group of connecting rods. The group has four connecting rods. The two higher connecting rods are sleeved around the cylinder pin of the clamping cylinder, while the other ends are connected to the two lower connecting rods movably about the X axis. The edges of the two lower connecting rods of the four connecting rods bite against a buckle and a steel strip inside the buckle at two bite points, with one bite point on each edge, deforming the buckle and subsequently clamping the steel strip firmly. In order to increase the clamp strength, the linkage mechanism includes a plurality of parallel groups. In one preferred embodiments, the amount of the group is two.

Along the X direction, the distance between the back surface of the buckle and the cutter is 3-10 mm.

In terms of design, the tensioning section includes two tensioning cylinders, increasing the pre-tension strength applied to a package. Also, these two cylinders may be parallel to each other, so as to decrease the unbalanced load on the tensioning cylinders. In this way, the tensioning cylinders are more endurable.

Moreover, a tensioning mechanism disposed between these two tensioning cylinders comprises an eccentric wheel, a tensioning spring and a kicker pin. The piston rod of each of the tensioning cylinders is fixed onto the two ends of a back rest along the Y direction. Two side rests are disposed along the X direction. A first end of each of the side rests is fixed on the back rest, while a second end sleeves on an end of the pin of the eccentric wheel. The end of the steel strip is pressed by a clamping tooth of the eccentric wheel and a working surface of a supporting table disposed under the eccentric wheel. The kicker pin is disposed to abut against to the eccentric wheel. The two ends of the tensioning spring are tied to the two side rests respectively, and the tensioning spring passes through a hole of the eccentric wheel.

The tensioning cylinders are reversible in terms of their direction of drive. As a result, the tensioning mechanism could be driven in the same direction. When the tensioning cylinders extend, the eccentric wheel would press the steel strip together with the working surface of the supporting table to provide a strong pressure thereon. Consequently, the eccentric wheel allows the thickness of steel strip to be 0-1.5 mm. The kicker pin is disposed to abut against to the eccentric wheel. When back rest gets closer to the kicker pin, the stress on the steel strip would disappear due to the movement of the eccentric wheel.

Moreover, a guide bar is disposed on the surface of the two tensioning cylinders respectively, distributing the stress on tensioning mechanism evenly and extending the operation life of the machine.

In a preferred embodiment, a hinge system is designed to facilitate placement of the steel strip into the hydraulic steel strapping machine. The hinge system is disposed on the front end of the two tensioning cylinders in the axial direction. The hinge system includes a hinge pin disposed along the Y direction, a cutter frame, and a hinge return spring. The hinge pin is fixed on the rear end surface of the back plate of the support frame by two trunnion seats disposed along the Y direction. The cutter frame includes two side frames and a cutter platform under the side frame. The side frames am respectively fixed onto the two tensioning cylinders along the X direction and are sleeved around the two ends of the hinge pin through a hole drilled on the side frame. The back end of the hinge return spring is disposed in a spring hole of the cutter frame.

As the steel strip is cut by the cutter, the tension disappears. The tensioning section consequently gets away from the clamping and cutting section, forming an angle $\delta$ between the axis of tensioning cylinders and the X axis via the hinge system. As a result, users could take out the steel strip easily. Then a new steel strip containing a buckle is placed between the eccentric wheel and the working surface of the supporting table. Making the angel $\delta$ be zero, and the buckle is therefore located between the edges. When the steel strip is tensioned, the front end of the cutter frame contacts the rear end surface of the back plate of the support frame. Meanwhile, the hinge return spring compresses in the spring hole disposed on the cutter frame.

In another embodiment, the working surface of the supporting table is flat plane or serrated plane, while the surface of the steel strip contacting the working surface is serrated plane, so as to increase the friction. The hardness of the steel strip is equal to or larger than 85 HRB (Rockwell B scale).

In one preferred embodiment, the clamping cylinder is a single acting hydraulic cylinder. In order to further improve the efficiency of the champing cylinder, in one embodiment, the clamping cylinder is a double acting hydraulic cylinder. The maximum output of the clamping cylinder is 4.5 t (tons).

Moreover, in on embodiment, the tensioning cylinders is single acting hydraulic cylinders or double acting hydraulic cylinders. The maximum output of the tensioning cylinders is 4.0 t. And the tension strength could therefore increase significantly.

BRIEF DESCRIPTION OF THE DRAWINGS

Further advantages and features of the invention emerge from the following description of an illustrative embodiment, wherein.

DETAILED DESCRIPTION OF THE PREFERRED EMBODIMENTS

Figure 1:
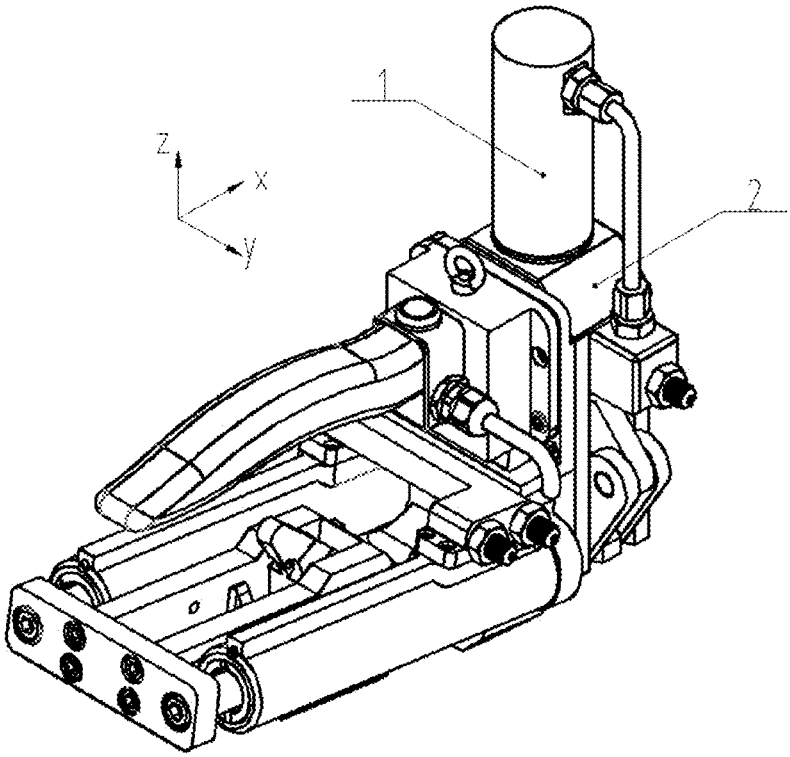
FIG. 1 shows the perspective view of the hydraulic steel strapping machine.
Figure 2:
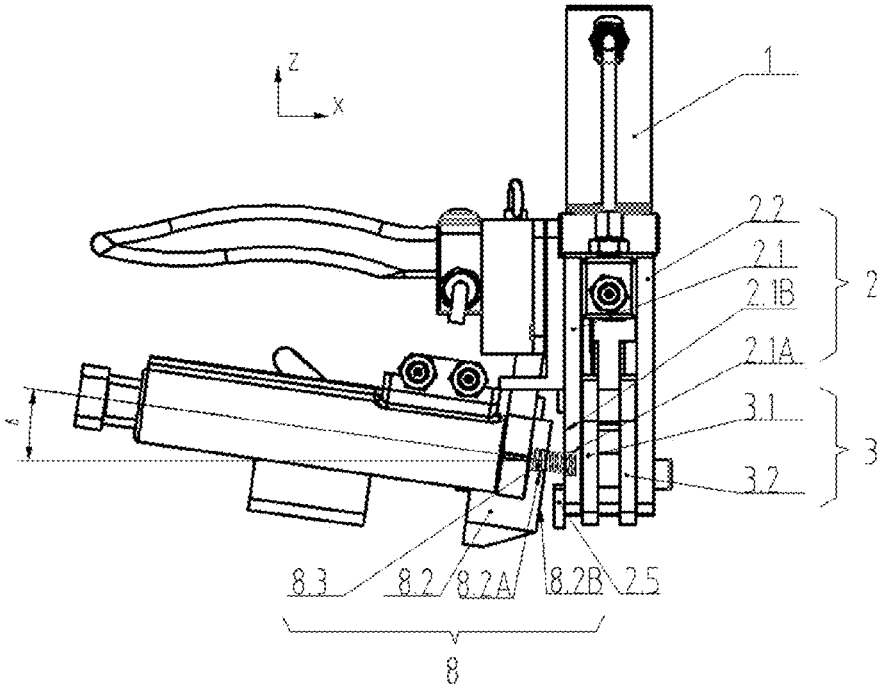
FIG. 2 shows the front view of the not working condition (plane X-Z), and illustrates that the front end is in the positive X direction.
Figure 3:
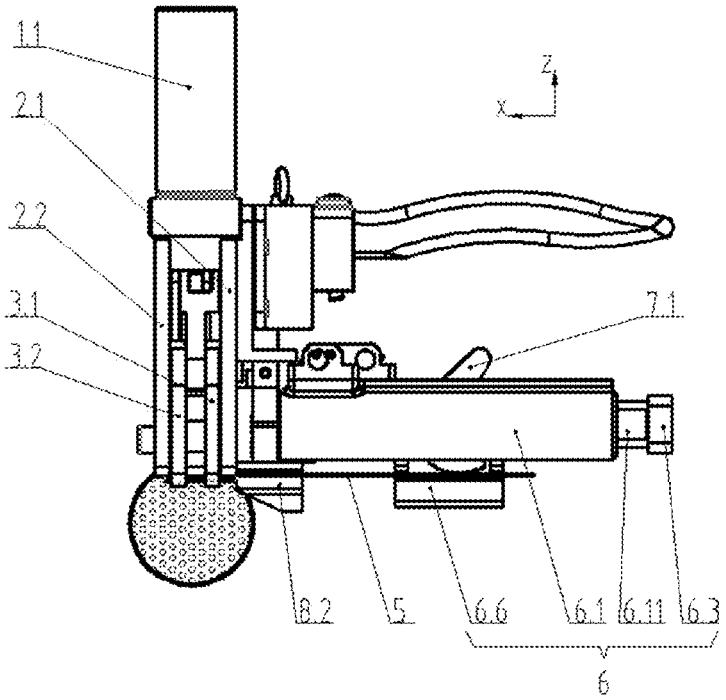
FIG. 3 shows the rear view of the working condition (plane X-Z)
Figure 6:
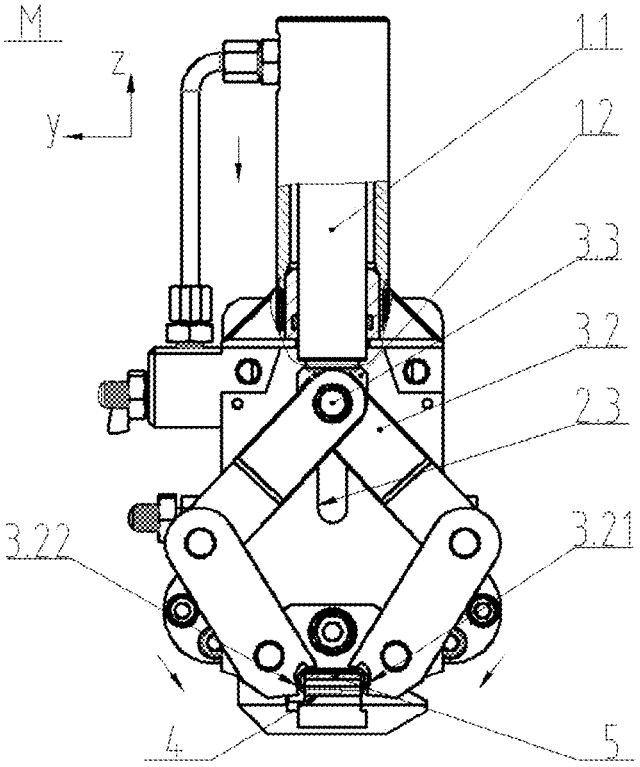
FIG. 6 shows the side view of removing the front plate along the M direction in FIG. 4 (plane Y-Z)
Figure 9:
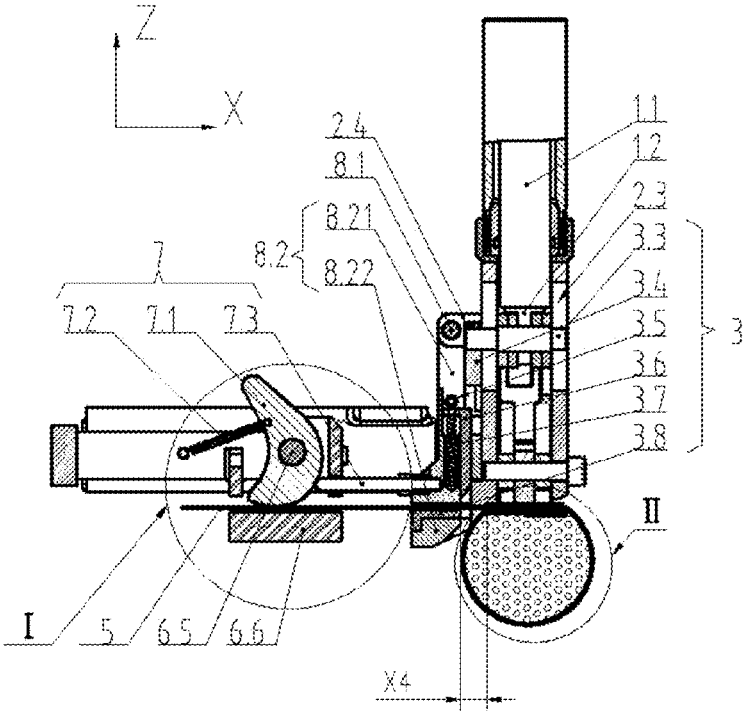
FIG. 9 shows the front view and partial cross-sectional view of the hydraulic steel strapping machine (plane X-Z)

The clamping and cutting section:

In FIG. 1, the hydraulic steel strapping machine in perspective view could be seen. A clamping cylinder 1 is disposed on the top portion of the front end of the hydraulic steel strapping machine along the Z direction. Beneath the clamping cylinder 1 is here found a support frame 2. In FIG. 2, the support frame 2 comprises a front plate 2.2 and a back plate 2.1. The linkage mechanism has two groups of connecting rods, the front group 3.2 and hack group 3.1. In FIG. 6 and FIG. 9, the linkage mechanism sets a cylinder pin 3.3 along, the X direction. The cylinder pin is sleeved by a lifting lug 1.2 fixed on the bottom surface of the piston 1.1 of the champing cylinder 1. In FIG. 9, the back end of the cylinder pin 3.3 is sleeved by a pressing part 3.4, below which a cutter 3.6, a return spring 3.7 and a transverse cutter 3.8 are disposed. The steel strip could be cut by the cutter 3.6 together with the transverse cutter 3.8.

Figure 7:
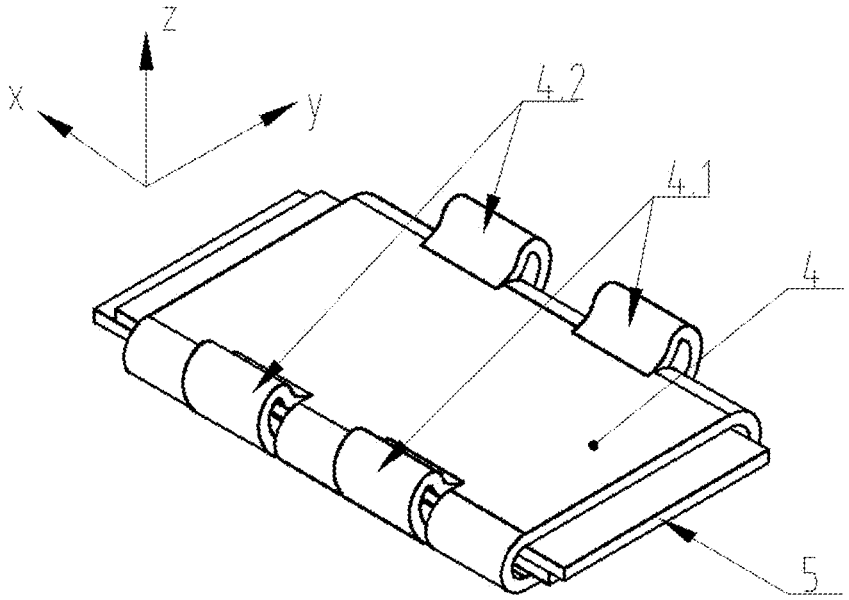
FIG. 7 shows the perspective view of the steel strip and the buckle which includes bite points.
Figure 11:
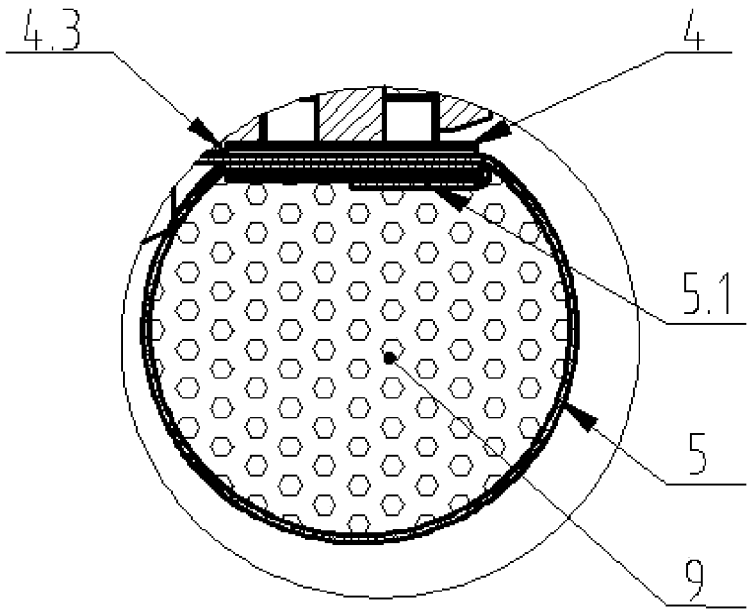
FIG. 11 shows the partially enlarged view of portion II in FIG. 9.

The edges 3.21 and 3.22 of the lower ends of the lower connecting rods are shown in FIG. 6. When the piston 1.1 of clamping cylinder moves down, the cylinder pin 3.3 is driven via the lifting lug 1.2. In this way, two opposite edges constitute a lock to clamp the buckle 4 and the steel strip 5, creating two bite points 4.2 on the buckle 4, as shown in FIG. 7. In FIG. 7, because of two parallel groups of connecting rods, two other bite points 4.1 are created. In FIG. 9 and FIG. 11, the distance between the back surface 4.3 of the buckle 4 and the cutter 3.6 along the X direction may be 3-10 mm.

In FIG. 9, after the clamping cylinder 1 is switched on, the piston 1.1 of the clamping cylinder moves down, driving the cylinder pin 3.3 to move downward in the slot 2.3 of the front plate and back plate. The opposite edges move toward each other and create bite points 4.1 and 4.2 on the buckle, as shown in FIG. 7. The buckle 4 and the steel strip 5 are subsequently clamped firmly. Then the pressing part 3.4 is driven by the cylinder pin 3.3, and presses the cutter 3.6. The steel strip 5 could be cut by the cutter 3.6 together with the transverse cutter 3.8. Finally, the piston of the clamping cylinder moves up. The linkage mechanism and the pressing part return to their initial positions. Without the pressure produced by the pressing part 3.4, the return spring 3.7 brings the cutter 3.6 back to the limited rod 3.5.

The clamping cylinder 1 is a single acting hydraulic cylinder and the maximum output thereof is 4.5 t.

Figure 5:
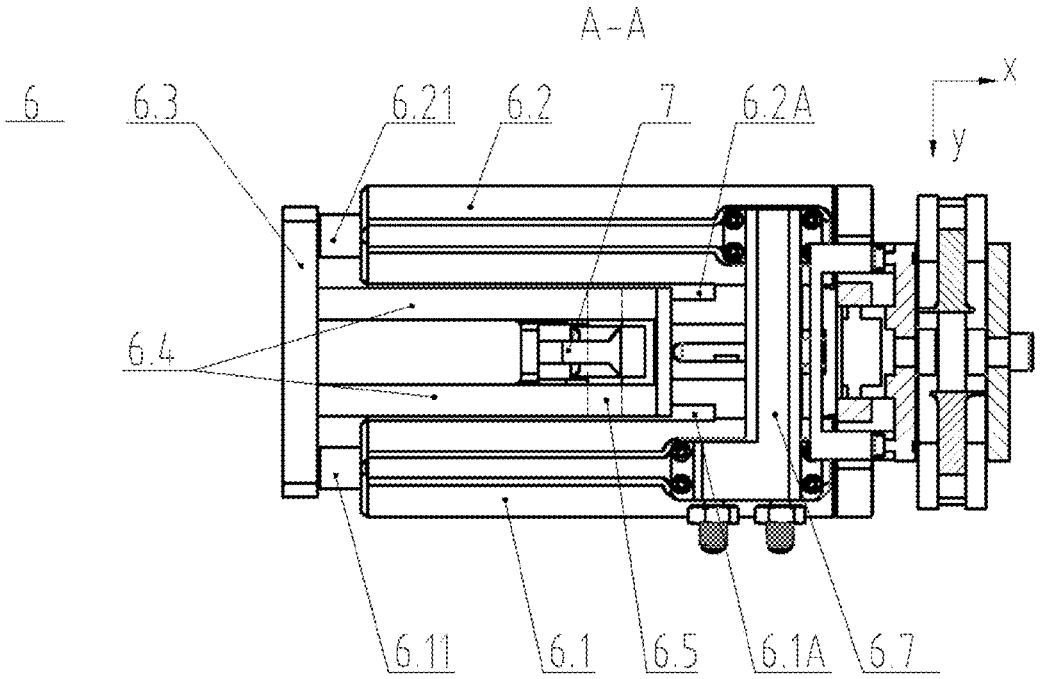
FIG. 5 shows a cross-sectional view along plane A-A in FIG. 4 (plane X-Y)

The tensioning section:

In FIG. 5, along the Y direction, the steel strip 5 and a tensioning mechanism 7 are disposed between two tensioning, cylinders 6.1 and 6.2. Two piston rods 6.11 and 6.21 of the tensioning cylinders are fixed on the two ends of a back rest 6.3 along the Y direction. Along the X direction, two side rests 6.4 are disposed. A first end of each of the side rests is fixed on the back rest, while a second end is sleeved onto the end of the pin 6.5 of an eccentric wheel 7.1, so as to increase the friction and subsequently the tension on the steel strip 5. A guide bar 6.1A and 6.2A is disposed on the surface of each of the tensioning cylinders, allowing the side rests 6.4 to be reciprocal movable along the X direction.

Figure 10:
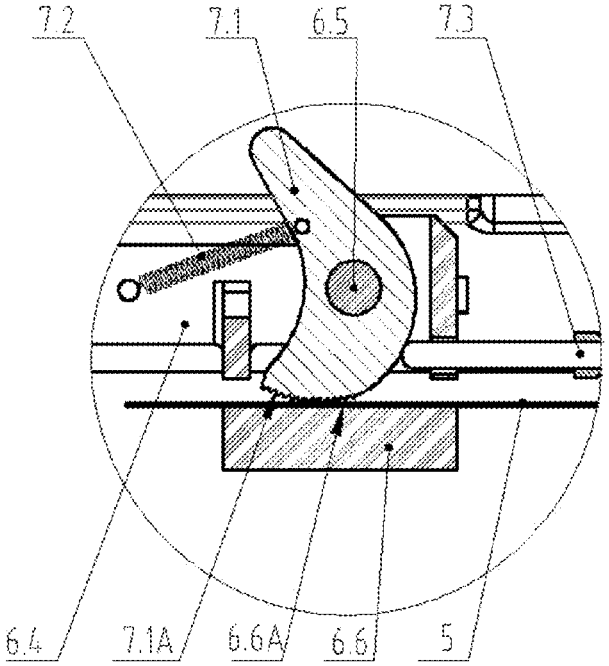
FIG. 10 shows the partially enlarged view of portion I in FIG. 9.

In FIG. 10, the end of the steel strip is pressed by a clamping tooth of the eccentric wheel and the working surface 6.6A of a supporting table disposed under the eccentric wheel. In order to enable the tensioning cylinders to drive the eccentric wheel, the two ends of a tensioning spring 7.2 are tied to the two side rests respectively, and the tensioning spring threads the hole of the eccentric wheel.

Both of the tensioning cylinders are double acting hydraulic cylinders whose maximum output is 4.0 t. The high output provides a strong tension that enables users to utilize a relatively thick steel strip 5. The thickness of the steel strip 5 is 0-1.5 mm.

An oil line 6.7 of the tensioning cylinders could be seen in FIG. 5.

In FIG. 10, a kicker pin 7.3 is disposed against the eccentric wheel. When the back rest 6.3 gets closer to the kicker pin, a slot would form between the clamping tooth and the working surface. In this way, the steel strip could be placed conveniently.

In FIG. 5, when actuating the tensioning cylinders, the back rest 6.3 is driven by the piston 6.11 and 6.21, reciprocally moving along the X direction. As a result, the pin 6.5 of the eccentric wheel 7.1 moves along the X direction as well. In FIG. 9, when the pin of the eccentric wheel pulls, the eccentric wheel 7.1 away from the kicker pin 7.3, along the negative X direction, the steel strip 5 is pressed strongly. Then the pressed steel strip is pulled continuously, and consequently strap the package 9 firmly.

In FIG. 10, the working surface of the supporting table 6.6A may be flat or serrated. The hardness of the steel strip is equal to or larger than 85 HRB. The surface of the steel strip contacting the working surface is serrated, leading to strong friction that enhances the tension strength.

Figure 8:
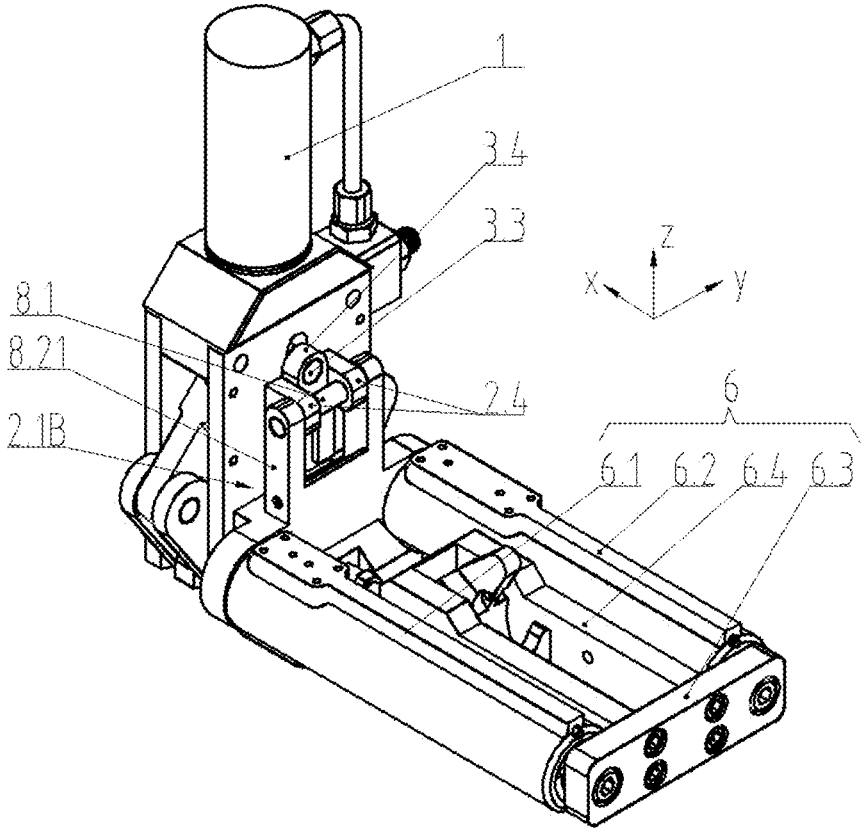
FIG. 8 shows the perspective view of the hydraulic steel strapping machine.

The hinge system:

In FIG. 2 and FIG. 8, a hinge system 8 is disposed on the front ends of the two tensioning cylinders. The hinge system 8 includes a hinge pin 8.12 disposed along the Y direction, a cutter frame 8.2 and a hinge return spring 8.3. FIG. 8 and FIG. 9 show that the hinge pin is fixed on the rear end surface 2.1B of the back plate 2.1 of the support frame 2 via two trunnion seats 2.4 placed along the Y direction.

In FIG. 9, the cutter frame includes two side frames 8.21 and a cutter platform 8.22 under the side frame 8.21. The side frames are respectively fixed onto the two tensioning cylinders along the X direction. In FIG. 8, the two side frames are sleeved around the two ends of the hinge pin through a hole drilled on the side frame.

FIG. 2 shows that the front end of the hinge return spring is placed in a spring hole 2.1A on the back plate 2.1, while the opposite end is put into another spring hole 8.2A of the cutter frame.

In FIG. 2, there are two situations that the steel strip is not under tension. The first one is when the steel strip is cut by the cutter, and the second one is under the not working condition. When these two situations happen, the hinge return spring 8.3 would return to its initial state, pushing the tensioning section to a further position away from the clamping and cutting section. Due to the hinge connection, the tensioning section would rotate around the hinge pin 8.1, subsequently forming an angle δ between the axis of tensioning cylinders and the X axis.

Figure 4:
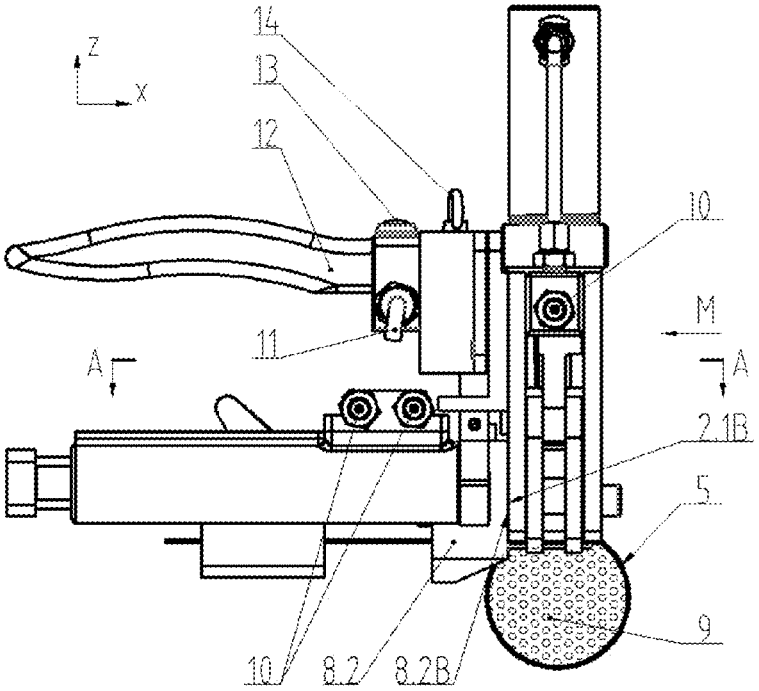
FIG. 4 shows the front view of the working condition (plane X-Z)

In FIG. 2 and FIG. 8, when under the working condition, the tensioning section rotates around the hinge pin, compressing, the hinge return spring 8.3. At the same time, the steel strip is under tension. FIG. 4 shows that during the working condition, the front end surface 8.2B of the cutter frame contacts the back end surface 2.1B of the back plate. The angle δ is 0. The hydraulic fluid port 10, the cable 11, the handrail 12, the button 13 and the hitch lug 14 in perspective view are shown in FIG. 4.

In FIG. 9 and FIG. 11, the steel strip 5 contains a bent section to avoid the movement thereof. A free end of the steel strip firstly passes through the buckle 4 from the back end. The free end then forms a loop around a package 9, and passes through the buckle 4 from the front end. In FIG. 10, the other end of the steel strip is placed between the eccentric wheel 7.1 and the supporting table 6.6.

In FIG. 2, in order to avoid the movement of the buckle 4 during pulling the steel strip 5, a lock plate 2.5 is fixed onto the back plate 2.1 of the support frame 2.

In FIG. 5 and FIG. 9, the tensioning mechanism 7 includes the eccentric wheel 7.1 and the supporting table 6.6, which are pulled by the tensioning cylinders 6.1 and 6.2. As a result, the steel strip is movable along the negative X direction. The tensioning spring 7.2 provides counter torque that allows the steel strip to be pressed more firmly.

In FIG. 6 and FIG. 9, when the tension on the steel strip achieves the required value, the clamping cylinder is actuated. The cylinder pin 3.3 subsequently moves down, driving the edges of the connecting rods to bite against the buckle, and form the bite points 4.1 and 4.2. Meanwhile the steel strip 5 is clamped strongly by the buckle 4. Then the pressing part 3.4 is driven by the cylinder pin 3.3, and presses the cutter 3.6. The steel strip 5 could be cut by the cutter 3.6 together with the transverse cutter 3.8. Finally, the piston of the clamping cylinder moves up. The linkage mechanism and the pressing part return to their initial positions. Without the pressure created by the pressing part 3.4, the return spring 3.7 brings the cutter 3.6 back to the limited rod 3.5.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A hydraulic steel strapping machine comprising:

a clamping and cutting section, comprising:

a support frame;

a linkage mechanism comprising two groups of connecting rods, each of the groups comprising four connecting rods, two lower connecting rods of the four connecting rods biting against a buckle and a steel strip inside the buckle at four bite points;

a clamping cylinder disposed on a top portion of the support frame along a Z direction and driving the linkage mechanism;

a cylinder pin disposed in the linkage mechanism along the X direction, and sleeved by a lifting lug fixed onto a bottom surface of a piston of the clamping cylinder;

a pressing part sleeved around the cylinder pin;

a cutter, a return spring and a transverse cutter, wherein each of the cutter, the return spring and the transverse cutter is disposed below the pressing part; and a distance between a back surface of the buckle and the cutter along the X direction is 3-10 mm;

a tensioning section comprising:

two tensioning cylinders;

a tensioning mechanism disposed between the tensioning cylinders;

a piston rod of each of the tensioning cylinders fixed onto two ends of a back rest along a Y direction, two side rests disposed along the X direction, a first end of each of the side rests fixed on the back rest, a second end sleeved onto an end of a pin of an eccentric wheel;

a guide bar disposed on a surface of each of the tensioning cylinders;

an end of the steel strip pressed by a clamping tooth of the eccentric wheel and a working surface of a supporting table disposed under the eccentric wheel;

a kicker pin disposed to abut against the eccentric wheel;

two ends of a tensioning spring tied to the two side rests respectively, and the tensioning spring passing through a hole of the eccentric wheel; and a thickness of the steel strip being 0-1.5 mm; and a hinge system disposed on front ends of the two tensioning cylinders in an axial direction, comprising:

a hinge pin disposed along the Y direction, a cutter frame, and a hinge return spring;

the hinge pin fixed onto a rear end surface of a back plate of the support frame by two trunnion seats disposed along the Y direction;

the cutter frame comprising two side frames and a cutter platform under the side frame, the side frames respectively fixed onto the two tensioning cylinders along the X direction and sleeved around two ends of the hinge pin through a hole drilled on the side frame; and a back end of the hinge return spring disposed in a spring hole of the cutter frame.

2. The hydraulic steel strapping machine as claimed in claim 1, wherein the working surface of the supporting table is flat or serrated, a surface of the steel strip contacting the working surface is serrated, and a hardness of the steel strip is equal to or larger than 85 HRB.

3. The hydraulic steel strapping machine as claimed in claim 1, wherein the clamping cylinder is a single acting hydraulic cylinder or a double acting hydraulic cylinder, and a maximum output of the clamping cylinder is 4.5 tons.

4. The hydraulic steel strapping machine as claimed in claim 1, wherein the tensioning cylinders are single acting hydraulic cylinders or double acting hydraulic cylinders, and a maximum output of the tensioning cylinders is 4.0 tons.

* * * * *